US008863455B2

(12) United States Patent
Cariaga et al.

(10) Patent No.: US 8,863,455 B2
(45) Date of Patent: Oct. 21, 2014

(54) UNITIZED PRECAST GRILLAGE FOUNDATION AND METHOD FOR MANUFACTURING THE SAME

(71) Applicant: Lafarge Canada Inc., Mississauga (CA)

(72) Inventors: Juan Ignacio Cariaga, Calgary (CA); Don Zakariasen, Calgary (CA)

(73) Assignee: Lafarge Canada Inc., Mississauga, ON (CA)

( * ) Notice: Subject to any disclaimer, the term of this patent is extended or adjusted under 35 U.S.C. 154(b) by 0 days.

(21) Appl. No.: 13/649,662

(22) Filed: Oct. 11, 2012

(65) Prior Publication Data

US 2014/0102025 A1 Apr. 17, 2014

(51) Int. Cl.
*E02D 27/42* (2006.01)

(52) U.S. Cl.
USPC ..... 52/299; 52/296; 52/295

(58) Field of Classification Search
USPC ..... 52/299, 296, 173.1, 334, 650.3, 651.01, 52/344, 348, 170, 295, 169.9, 223.7
See application file for complete search history.

(56) References Cited

U.S. PATENT DOCUMENTS

| | | | | | |
|---|---|---|---|---|---|
| 488,451 | A | * | 12/1892 | Quatermass | 52/82 |
| 1,609,260 | A | * | 11/1926 | Malone | 52/166 |
| 1,777,469 | A | | 10/1930 | Luippold et al. | |
| 2,194,279 | A | * | 3/1940 | Goldsborough | 405/149 |
| 2,374,624 | A | * | 4/1945 | Schwendt | 52/223.5 |
| 2,435,998 | A | * | 2/1948 | Cueni | 52/223.8 |
| 3,918,222 | A | * | 11/1975 | Bahramian | 52/223.7 |
| 5,657,597 | A | * | 8/1997 | Loftus | 52/274 |
| 5,797,227 | A | * | 8/1998 | Garza-Tamez | 52/167.1 |
| 5,826,381 | A | * | 10/1998 | Sasaki | 52/175 |
| 6,094,873 | A | * | 8/2000 | Hoffman et al. | 52/126.6 |
| 6,718,711 | B1 | * | 4/2004 | Gilman | 52/299 |
| 7,618,217 | B2 | * | 11/2009 | Henderson | 405/255 |
| 7,624,550 | B2 | * | 12/2009 | Ospina | 52/334 |
| 2002/0017068 | A1 | * | 2/2002 | Monachino | 52/247 |
| 2008/0209848 | A1 | * | 9/2008 | Kinzer | 52/745.01 |
| 2012/0304564 | A1 | | 12/2012 | Kurczynski et al. | |

FOREIGN PATENT DOCUMENTS

| | | |
|---|---|---|
| CN | 201358468 | 12/2009 |
| CN | 101532288 | 9/2011 |
| JP | 2010-70903 | 4/2010 |
| JP | 2012097428 | 5/2012 |
| JP | 2012154042 | 8/2012 |
| WO | 2012005792 | 1/2012 |

OTHER PUBLICATIONS

ISR of PCT/CA2013/050773.

* cited by examiner

*Primary Examiner* — Basil Katcheves
(74) *Attorney, Agent, or Firm* — Norton Rose Fulbright Canada LLP

(57) ABSTRACT

The present invention discloses a unitized precast grillage foundation for supporting a structure comprising: a plurality of anchoring elements defining a grid for resting on an underlying surface; a base connected on the grid, the base comprising at least a first footing and a second footing spaced apart and at least one connecting member between and connected to the at least first footing and the second footing; and a beam-column projecting upwardly from the base, and a method of making same.

8 Claims, 6 Drawing Sheets

UNITIZED PRECAST GRILLAGE FOUNDATION AND METHOD FOR MANUFACTURING THE SAME

FIELD OF THE INVENTION

The present invention relates to unitized precast grillage foundation for supporting a structure and to methods of manufacturing such a unitized precast grillage foundation, made of a cementitious mixture.

BACKGROUND

Typically, grillage foundations used, support various structures, for example, electrical transmission lines that are normally designed to transfer and distribute heavy concentrated loads on soil having low bearing capacity. These grillage foundations resist uplift and thrust forces that result from the self-weight of the tower and the lateral and longitudinal transmission wire loads in normal and/or broken wire conditions. In addition to such forces, the foundation also resists wind and ice loads on the tower body, the insulators, and the conductors.

The grillage foundations of the prior art consist of one or more layers of galvanized steel beams perpendicular to each other and assembled on site.

Currently, the electrical transmission industry is experiencing an increasing corrosion challenge in the galvanized steel members typically near to the ground level and underground. The fact that the grillage foundations are underground and not easily accessible for maintenance inspections, increase the risk of sudden tower failures which may cause to electrical outages. For these reasons, the existing steel grillage foundation is a less reliable solution for the electrical transmission line industry.

Moreover, the galvanized steel material used in the grillage foundations has delivery lead times of six months or longer. It is important to note that in some jurisdictions the construction window for electrical transmission lines is only four months. For this reason, ordering material with long lead times does not allow engineering to match design with real soil requirements that can only be obtained through construction season. Moreover, since the grillage foundation is a framework of galvanized steel with wide flange beams and channels, the material is shipped as separate pieces needed to be assembled on site. For this reason, labour costs become the cost factor for such steel grillage foundations.

SUMMARY

In accordance with one aspect of the present invention, there is provided a unitized precast grillage foundation for supporting a structure comprising: a plurality of anchoring elements defining a grid for resting on an underlying surface; a base connected on the grid, the base comprising at least a first footing and a second footing spaced apart and at least one connecting member between and connected to the at least first footing and the second footing; and a beam-column projecting upwardly from the base.

In accordance with an aspect of the unitized precast grillage foundation of herein described, the beam-column projects upwardly from the base at an angle less that 90° above the horizontal.

In accordance with another aspect of the unitized precast grillage foundation herein described, the at least one connecting member and beam-column form an inverted T-shape cross-section connected between the at least first footing and the second footing.

In accordance with yet another aspect of the unitized precast grillage foundation herein described, the plurality of anchoring elements are concrete beams in the grid longitudinally aligned and transverse the at least first footing and second footing.

In accordance with still another aspect of the unitized precast grillage foundation herein described, the plurality of concrete beams are I-beams.

In accordance with yet still another aspect of the unitized precast grillage foundation herein described, a plurality of concrete beams are Ultra High Performance Fiber Reinforced Cementitious Compositions.

In accordance with a further aspect of the unitized precast grillage foundation herein described, the at least first footing and a second footing are High Performance Sulfate Resistant concrete footings.

In accordance with yet a further aspect of the unitized precast grillage foundation herein described, wherein the connecting member and beam-column are a High Performance Sulfate Resistant concrete member.

In accordance with still a further aspect of the unitized precast grillage foundation herein described, the beam-column further comprises a telescopic system located at the top of the beam-column connectable to the structure to be supported.

In accordance with another aspect of the present invention, there is provided the unitized precast grillage foundation of claim 10, wherein the telescopic system comprises a plate embedded to the top of the beam-column with a central hole, and an adjustable steel section being received within the central hole and connected to the plate, wherein the adjustable steel section includes a top steel plate connection connectable to the structure to be supported.

In accordance with yet another aspect of the present invention, there is provided a method of manufacturing a unitized precast grillage foundation comprising: providing a plurality of anchoring elements; laying the plurality of anchoring elements in a grid formation; connecting a reinforcement cage transversely across and to each anchoring element of the grid formation; and connecting the reinforcement cage to a beam-column comprising a supporting re-bar through a connection between the reinforcement cage and the supporting re-bar; forming a mould or moulds around the reinforcement cage and the supporting re-bar connection; pouring a cementitious mixture into the mould or moulds; and allowing the cementitious mixture to harden.

In accordance with yet still a further aspect of the method herein described, the beam-column is attached to a connecting member comprising the supporting re-bar connection.

In accordance with one embodiment of the method herein described, connecting the reinforcement cage to the each anchoring element of the plurality of anchoring elements is with a bar stirrup affixed into each beam.

In accordance with another embodiment of the method herein described, the beam-column connected to the grillage foundation is at an angle less that 90° above the horizontal.

In accordance with yet another embodiment of the method herein described, the connection of the reinforcement cage and the supporting re-bar is via interlacing of the reinforcement cage and the supporting re-bar.

In accordance with still another embodiment of the method herein described, the cementitious mixture poured into the mould or moulds is High Performance Sulfate Resistant concrete.

In accordance with another embodiment of the method herein described, the beam column and the connecting member are pre-stressed beam.

Some advantages of the unitary precast concrete grillage foundation of the present application include:

- Excellent durability
  - Corrosion resistant
  - Non conductive (Electrically)
  - Freeze/thaw resistant
  - Sulfate resistant
  - A life expectancy of 100 years
- Structural design and local production
  - A capacity for heavy uplift and compressive loads. 100 year event design loads
  - Flexibility to adjust design according to real soil requirements.
  - Local precast just in time production with capacity that matches site installation capacity.
- Constructability benefits.
  - No site assembly required
  - Speed of construction
  - Ease of backfill and compaction compared to truss steel system
  - Flexibility in height adjustments
  - Flexibility in horizontal adjustments
  - Adjustable to meet different soil types
- Safety benefits.
  - Single point lift and/or four point lift that allows for leveled installation without need of people in the excavated hole.
- Sustainability benefits
  - Economical: Cost savings on initial cost and life cycle cost
  - Extreme durability with no maintenance required providing for an enhanced life cycle assessment
  - Environmental: Use of fly ash as post consumer recycle product
  - Environmental: Use of silica fume as post consumer recycle product
  - Environmental: Regional proximity for sourcing finish products
  - Social & Economical: Government employment generation for new production plants

BRIEF DESCRIPTION OF THE DRAWINGS

Reference will now be made to the accompanying drawings, showing by way of illustration particular embodiments of the present invention and in which.

DETAILED DESCRIPTION

Figure 1:
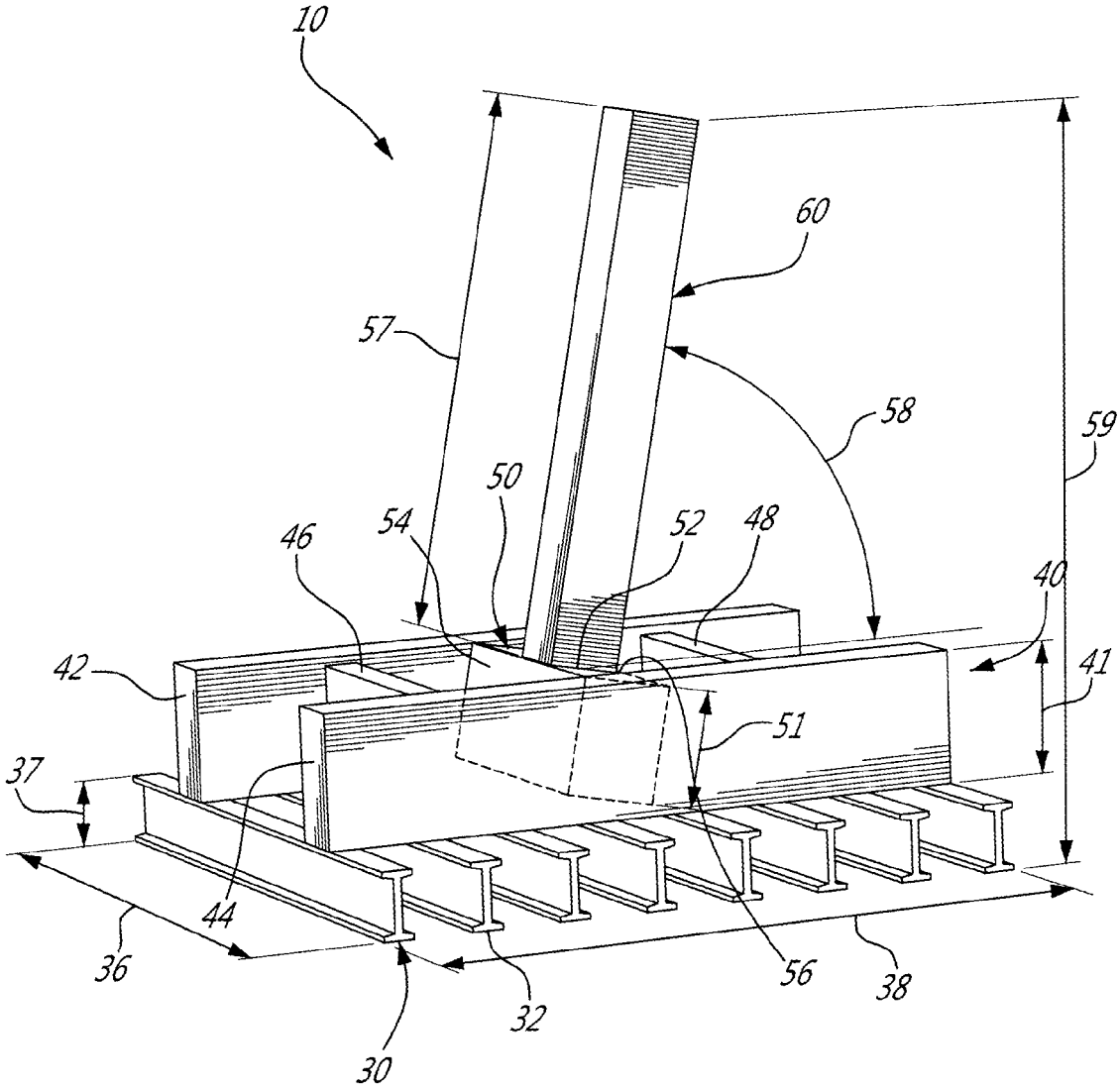
FIG. 1 illustrates an isometric view of a unitized precast grillage foundation according to an embodiment of the present invention.

Referring to the drawings and more particularly to FIG. 1, the unitized precast grillage foundation 10 of the present disclosure includes a grid 30, a base 40 connected on the grid 30, and a beam-column 60 projecting upwardly from the base 40.

The term "unitized" as used herein is understood to refer to the grillage foundation 10 of the present application being unitized as a complete assembly which is fully assembled and does not need to be assembled at a construction site.

The term "precast" as used herein is understood to refer to the grillage foundation being produced by casting concrete in a reusable mold or "form" which is then cured in a controlled environment, transported to the construction site and lifted into place.

The term "beam-column" as used herein is understood to refer to at least one column 60 projecting upwardly from the base 40 which resists thrusts in the direction of its own length. In a preferred embodiment, only one beam-column 60 is attached to a connecting cross-member 50, and together they make an (inverted) T-shaped beam-column. In a preferred embodiment, the beam column 60 is pre-stressed before attachment to the footings. In a particularly preferred embodiment both the beam column 60 and the connecting member 50 are pre-stressed before attachment to the footings.

The term "cementitious mixture" is a mixture of cementitious material(s) and hydraulic cement. In a preferred embodiment, the cementitious mixture is a concrete.

Still referring to FIG. 1, a plurality of anchoring elements that are in a preferred embodiment, concrete beams 32 that define a grid 30 for resting on an underlying surface is shown. The grid 30 may comprises any suitable numbers of beams 32. As shown in FIG. 1, the grid 30 comprises eight beams 32 evenly spaced and parallel to each other. However, it is understood that between 4 and 12 beams 32 may be used, that the beams 32 do not need to be evenly spaced nor be exactly parallel to each other. However, the beams are preferably at least partially aligned to define grid 30, and so as to distribute the weight evenly from the structure. The beams generally have the same length 36, that is typically from 3 to 5 m (3.25 m preferred) and a height 37 of 0.2 m to 0.4 m with 0.3 m being preferred.

As shown in FIG. 1, the beams 32 have a I-shape. However, it is understood that other beam shape such as, for example, S-shape, C-shape or L-shape or the like are also possible. In at least another embodiment, the beams 32 are composed of Ultra High Performance Fiber Reinforced Cementitious Composition. The beams 32 are prestressed and produced in accordance with Lafarge's patented UHPC branded under trade-mark DUCTAL™. Such composites are disclosed in U.S. Pat. Nos. 6,478,867; 6,881,256; and 6,723,162 which are specifically incorporated herein by reference.

The base 40 comprises at least a first footing 42 and a second footing 44 spaced apart, and at least one connecting cross member 50 positioned between and connected to the at least a first footing 42 and a second footing 44 (or first and second transverse beams). As shown in FIG. 1, the at least a first footing 42 and a second footing 44 are generally parallel to each other and positioned substantially transverse to, and in a preferred embodiment perpendicular to the plurality of beams 32 of the grid 30. The footings are mounted on the grid 30, and connected to the beams 32 such that weight is transferred downward to the grid. The length of the footings 38 corresponds substantially to the breadth of the grid 30, and generally equal to the length of the beam (from 3 to 5 m). The footings generally have a height 41 that is from 0.3 to 0.6 m, with 0.525 m being preferred, and a width 43 (FIG. 2) from 0.2 to 0.4 m, with 0.25 m preferred. The height 41 and the width 43 may vary along the length of the footings 42 and 44. It is understood that any suitable spaced apart arrangement of the at least first footing 42 and second footing 44 on the grid 30 is possible.

In an alternative embodiment, there may be a single footing having the same length and in contact with all the beams 32 of the grid 30 but a wider breadth, approximately equal the distance between the two footings 42 and 44. This type of single footing base may have a footprint similar to that produced by the first footing 42 and second footing 44, illustrated in FIG. 1. This single footing arrangement is less preferred, and adds additional weight to the base 40.

The at least first footing 42 and a second footing 44 are physically connected to the plurality of beams 32 of the grid 30 by any suitable connection means which may be used for the purposes of the grillage foundation 10. In at least one embodiment (not shown), the at least a first footing 42 and a second footing 44 are connected to the I-beams 32 of the grid 30 by non-corrosive steel dowel connections. In at least another embodiment, the at least first footing 42 and second footing 44 are composed of High Performance Sulfate Resistant Prestressed Concrete (HPC).

The base 40 may comprise one or more braces positioned between and connected to the at least a first footing 42 and a second footing 44 for more support. The one or more braces may be any suitable material, for example, concrete or the like. The braces may be connected to the at least a first footing 42 and a second footing 44 by any suitable connection means which may be used for the purposes of the grillage foundation 10. Alternatively, the one or more braces may be integrally formed with the at least first footing 42 and second footing 44. As shown in FIG. 1, the base 40 may comprise a first concrete brace 46 and a second concrete brace 48 positioned between and connected to the at least a first footing 42 and a second footing 44. In a preferred embodiment (not illustrated) the footings 42 and 44 may include 2 or more lifting loops, in a particularly preferred embodiment there are four loops per grillage foundation 10 and the lifting loops are made of steel, each loop upwardly extending from the footings and positioned adjacent the optional braces 46 and 48.

Still referring to FIG. 1, the at least one concrete cross member 50 may be combined with the beam-column 60 to produce a T-shape beam-column 52, that is positioned in an inverted orientation. The T-shaped beam 52 cross member 50 has opposed ends 54,56 each connected to the at least a first footing 42 and a second footing 44. However, it is understood that other shapes to the cross-member 50/beam-column 60 other than the T-shaped beam-column 52 are also possible. The cross-member length 53 (FIG. 2), is the distance between the first footing 42 and the second footing 44, and is between 1 and 2 m long, with 1.3 m being preferred. The cross-member has a cross-sectional height 51 (aligned along the length 57 of the beam-column), in a range from 0.4 to 0.5 m, with 0.425 m being particularly preferred.

The connecting cross-member 50 may be an arc, convex or concave, or an inverted V. It is also understood that the connection between the (inverted) T-shape beam-column 52 and the at least a first footing 42 and a second footing 44 may be any suitable connection means which may be used for the purposes of the grillage foundation 10. In at least an embodiment, the at least one connecting member 50 is composed of High Performance Sulfate Resistant Prestressed Concrete (HPC).

Although the beam-column 60 can have a vertical orientation (at 90° angle 58 from the horizontal), in a preferred embodiment the beam-column 60 has an angle 58 from the horizontal less than 90° and is greater than 45°; more preferably greater than 60°, and most preferably greater than 70°. In a particular preferred embodiment the angle 58 is 75° or 79° from the horizontal plane.

In at least one embodiment, the beam-column 60 is attached to the at least one concrete member 50, however, the beam-column 60 may alternatively be attached to the base 40 at least at the first footing 42, and the second footing 44, or a combination of the at least a first footing 42 and a second footing 44 and the at least one concrete cross-member 50. As shown in FIG. 1, the at least one concrete cross-member 50 and the beam-column 60 are integrally formed. The term "integrally formed" as used herein is understood to refer to the beam-column 60 being formed with concrete reinforced material common with the at least one concrete member 50, and the connection having no mechanical joints. The term "integrally formed" equally applies to the complete grillage foundation 10.

Figure 2:
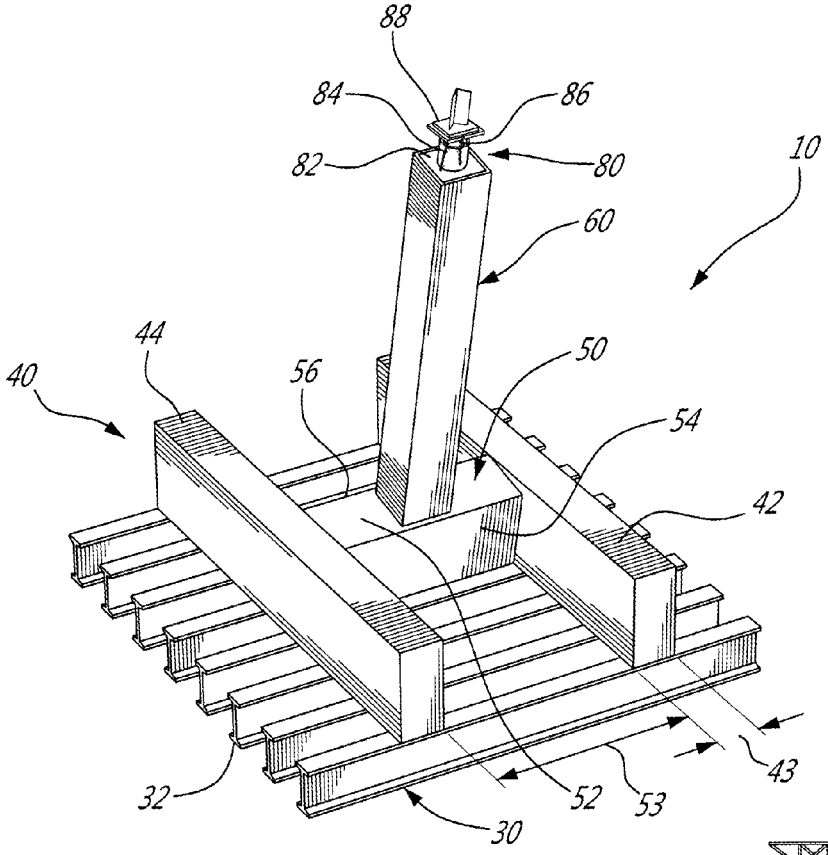
FIG. 2 illustrates another isometric view of the unitized precast grillage foundation of FIG. 1 including a flexibility system connectable to a structure to be supported.
Figure 2B:
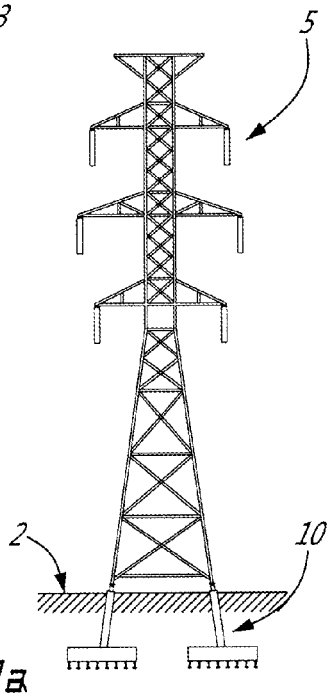
FIG. 2*a* is a schematic representation of a transmission line including the underground placement of the grillage foundation of the present invention.

The top of the beam-column 60 is connectable to a structure to be supported, for example, to one of the feet of a transmission tower. The column 60 may comprise a telescopic system 80 including a beam-column connecting plate 82 embedded to the beam-column 60. In a preferred embodiment the connecting plate 82 is a steel plate defining a central hole that is connected by welding or otherwise embedded into the top of column 60. A typically cylindrical and optionally hollow male steel section 86 is received within the central hole of the connecting plate 82, adjusted to height and then welded in place to the connecting plate 82. The column 60 therefore defines a hollow portion at the top of the column 60 into which the male section 86 has space to enter. Turning to FIG. 2, in another embodiment the connecting plate 82 includes a hollow female steel section 84 projecting longitudinally upward from the plate 82 beam-column 60, an adjustable typically cylindrical hollow male steel section 86 being received within the hollow female steel section 84, and equipped with a structure connecting steel plate 88 to which the beam-column 60 of the grillage foundation 10 is connectable to the structure to be supported. The telescopic system 80 has the advantage of providing vertical and horizontal flexibility for adjusting the connection between the structure to be supported and the unitized precast grillage foundation 10.

The vertical flexibility is achieved by adjusting the round hollow male steel section 86 inside the hollow female steel section 84. Once the vertical adjustment is made, the round hollow steel section 86 is welded inside the hollow steel section 84. Clearly, the positions of sections 84, 86 can be inverted such that the hollow female section is connected to the structure.

The horizontal flexibility is achieved by allowing a clearance of ±25 mm in any directions. A part of the structure to be supported may therefore be connected to the steel plate connection 88. It is understood that the connection may be achieved through any suitable connection such as, for example, welding of the part to the structure to be supported to the steel plate connection 88.

Referring now to FIG. 2*a*, illustrated is a schematic representation of an electrical transmission tower supported by the unitized precast grillage foundation of the present invention. It should be noted that the grillage foundation is angled to best support the lower structure of the electric transmission tower and that the grillage foundation is installed below grade 2.

Figure 3:
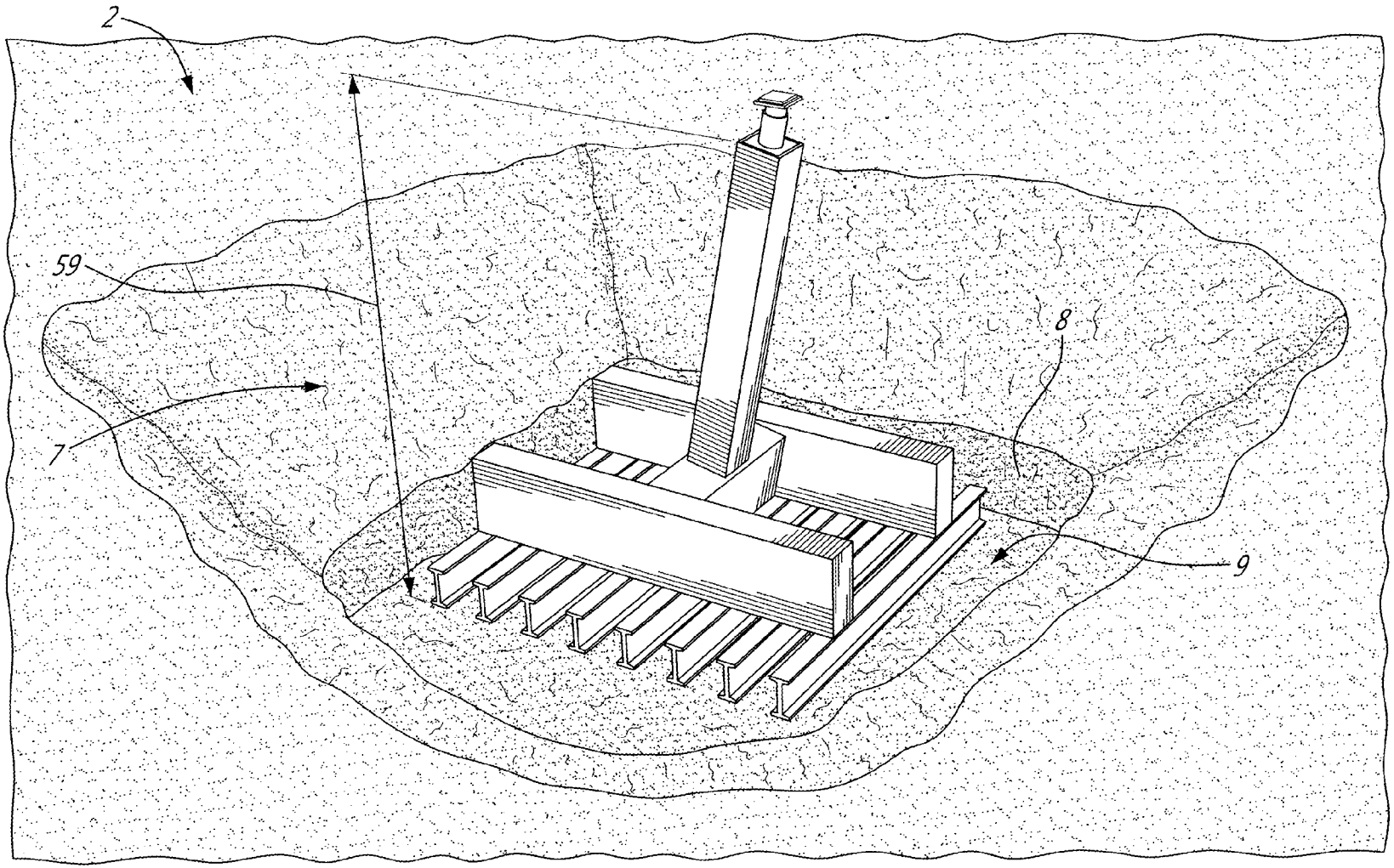
FIG. 3 illustrates a schematic view of the grillage foundation of FIG. 1 within a pit during placement of the grillage foundation according to FIG. 1.

Turning to FIG. 3 that illustrates the installation of the grillage foundation in a pit 7 on a leveled surface 9, such that the pit is roughly the height 59 of the grillage foundation 10. The pit made for the grillage foundation 10 may be one that has slopped walls 7 or straight walls 8 or a combination thereof. An important feature of the pit is that the ground on which the grillage foundation sits is compressed and leveled. It must also be noted that the grillage foundation 10 described herein does not require installation within a concrete walled pit, as required by the steel structures used presently.

Example

In use, four unitized precast grillage foundations of the present application for supporting a four legged overhead line tower type RC22A-2 with the following foundation reaction:

| LOAD TYPE | VERTICAL (kN) | TRANSVERSE SHEAR (kN) | LONGITUDINAL SHEAR (kN) |
|---|---|---|---|
| Compression | 672 | 105.7 | 103.8 |
| uplift | 536.9 | 87 | 80 |

Transverse and longitudinal shear are resisted in the same manner as the conventional steel grillage foundation with single W-sections stub legs.

Figure 4:
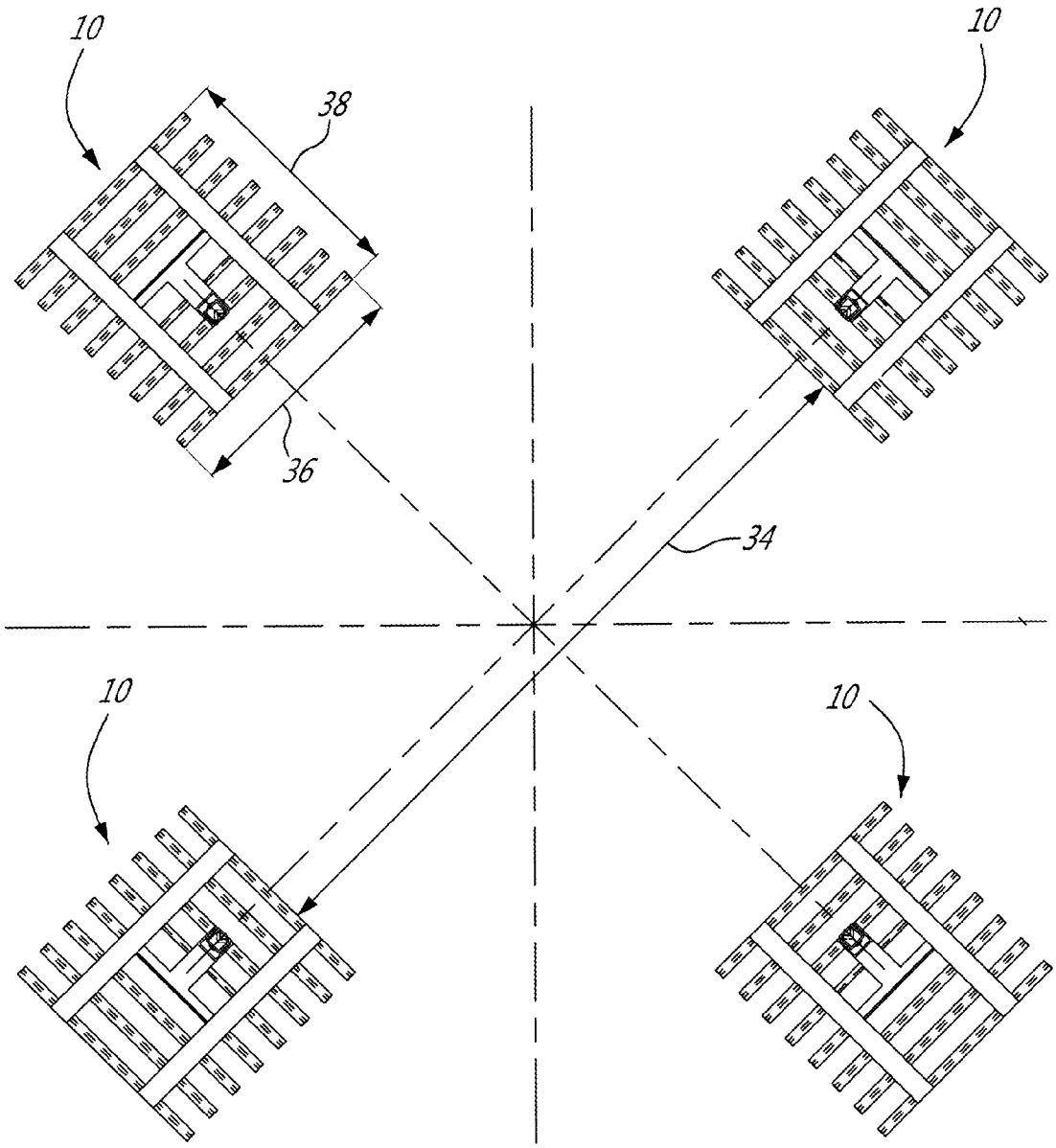
FIG. 4 illustrates a plan view of the footprint and placement of four unitized precast grillage foundations of FIG. 1 for supporting a four legged overhead line tower type RC22A-2.

The four grillage foundations may be disposed such that each of four tower leg plates of the overhead line tower is supported. As illustrated in FIG. 4, four grillage foundations 10 in accordance with the present description are each disposed in a respective corner of an imaginary square, each corner corresponding to a position of each legs of the overhead line tower. FIG. 4 furthermore illustrates that the length of the beam 36 and the width of the grid 38 may be the same length, however the beam length 36 and the grid length 38 may have different values. Typically the beam length is 20 feet and the grid length is 20 feet. It is understood that the number of grillage foundations 10 needed as well as their configurations may vary depending on the configuration of the structure to be supported. The distance 34 between opposite grillage foundations 10 is roughly three times their length or from 12 to 20 m, with 15 m being a preferred distance.

Figure 5:
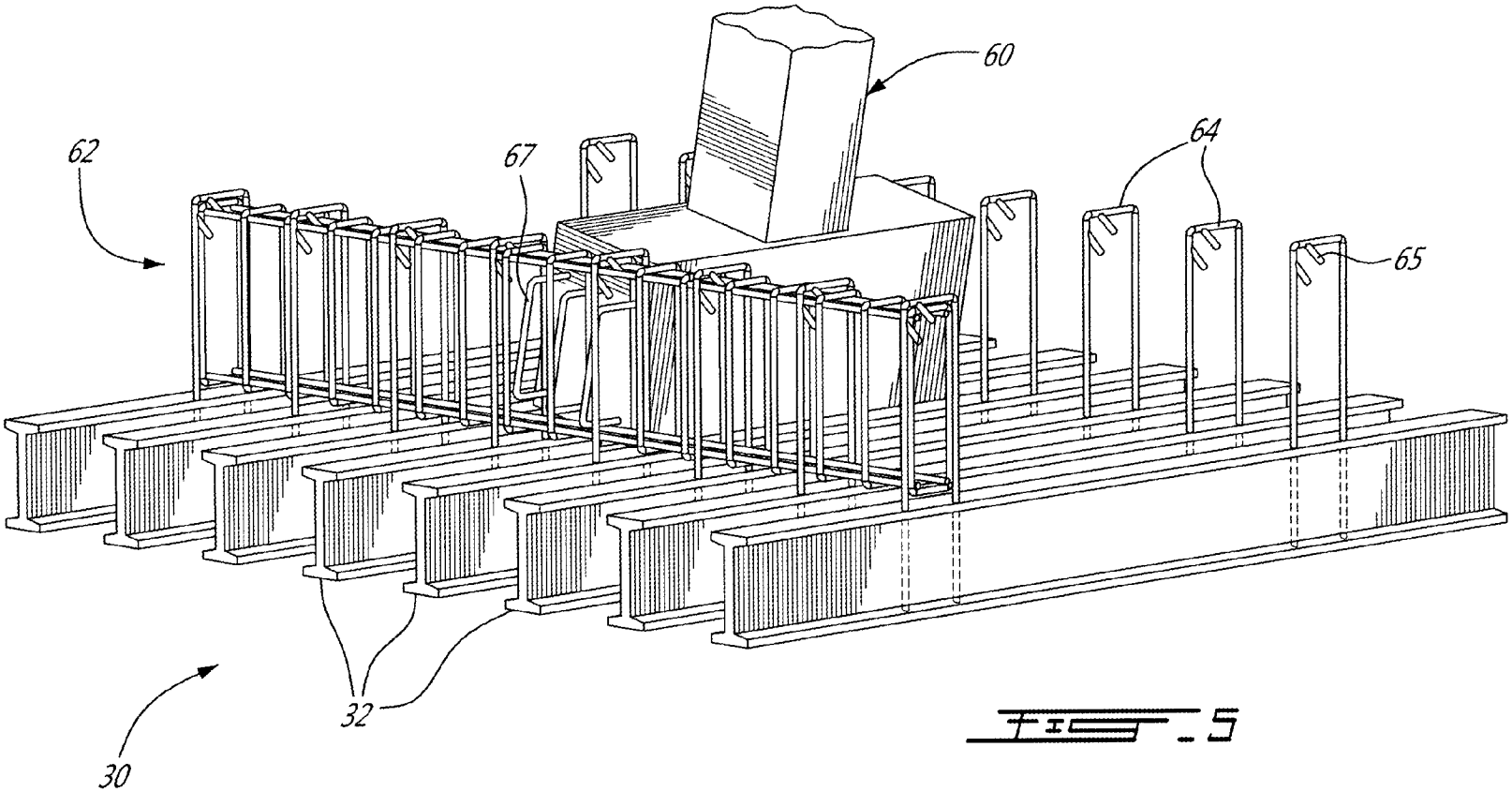
FIG. 5 is an isometric view of the placement of a reinforcing cage structure of the footing on the anchoring grid of the grillage foundation according to one embodiment.
Figure 6:
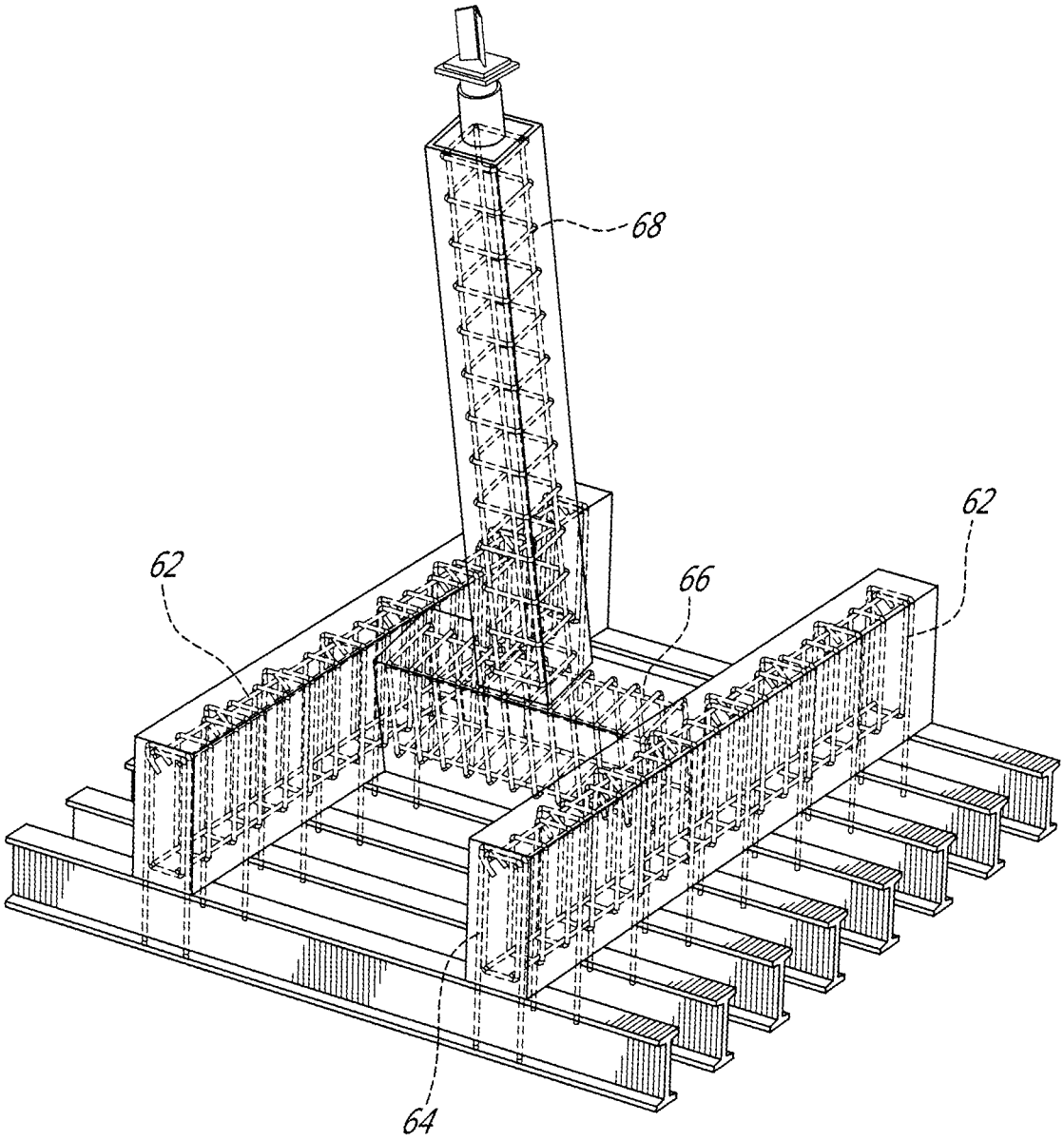
FIG. 6 illustrated an isometric view of the grillage foundation including an internal view of the reinforcing cage members according to one embodiment of the present invention.

Turning to FIG. 5 illustrating the method for making the grillage foundation 10. First of all, a plurality of appropriate anchoring elements that are in a preferred embodiment beams are provided. The anchoring elements are laid on a flat surface in a grid formation. In a preferred embodiment the anchoring elements are placed parallel to one another. In a further embodiment, the anchoring elements are laid equidistant from one another.

Subsequently, a reinforcement cage or re-bar structure is placed transversally across and connected to each of the anchoring elements of the grid formation. A variety of connecting means including stirrups 64 comprising placement projection 65 are attached to the beams. The cross-member and beam-column comprise projecting outwardly from the cross-member through the reinforcing structure footing 62. The reinforcing structure footing 62 and the reinforcing structure cross-member extension 67 may be interlaced, welded or interlaced and welded in such a way as to ensure the solid placement of the cross-member and beam-column. Although not indicated, various placement projections may also be included in the structure connecting the reinforcing structure footing 62 and the reinforcing structure cross-member extension 67.

Therefore, the base of the grillage foundation is connected through a rebar base structure 62 and supporting rebar extension 67 extending from the cross-member. With the beam-column 60 in the correct stable orientation with or without an angle 58 from the horizontal. A mold or molds is formed around the reinforcement cage re-bar structure footing. A cementitious mixture/concrete is then poured into the molds forming the grillage structure. The formed footage are not pre-stressed.

The preferred type of cementitious mixture/concrete is a high performance sulphate resistant concrete. The concrete is then permitted to harden.

Although the invention has been described in detail in the foregoing for the purpose of illustration, it is to be understood that the scope of the claims should not be limited by the preferred embodiments set forth in the examples, but should be given the broadest interpretation consistent with the description as a whole.

The invention claimed is:

1. A unitized precast grillage foundation for supporting an electronical transmission tower comprising:

a plurality of anchoring elements defining a grid for resting on an underlying surface;

a base connected on the grid, the base comprising at least a first footing and a second footing spaced apart and at least one connecting member between and connected to the at least first footing and the second footing; and a beam-column projecting upwardly from the base, wherein the at least one connecting member and beam-column form an inverted T-shape cross-section connected between the at least first footing and the second footing, wherein the beam-column further comprises a telescopic system located at the top of the beam-column connectable to the structure to be supported, and wherein the telescopic system comprises a plate embedded to the top of the beam-column with a central hole, and an adjustable steel section being received within the central hole and connected to the plate, wherein the adjustable steel section includes a top steel plate connection connectable to the structure to be supported.

2. The unitized precast grillage foundation of claim 1, wherein the beam-column projects upwardly from the base at an angle less that 90° above the horizontal.

3. The unitized precast grillage foundation of claim 1, wherein the plurality of anchoring elements are concrete beams in the grid longitudinally aligned and transverse the at least first footing and second footing.

4. The unitized precast grillage foundation of claim 3, wherein the plurality of concrete beams are I-beams.

5. The unitized precast grillage foundation of claim 3, wherein a plurality of concrete beams are Ultra High Performance Fiber Reinforced Cementitious Compositions.

6. The unitized precast grillage foundation of claim 1, wherein the at least first footing and a second footing are High Performance Sulfate Resistant concrete footings.

7. The unitized precast grillage foundation of claim 1, wherein the connecting member and beam-column are a High Performance Sulfate Resistant concrete member.

8. The unitized precast grillage foundation of claim 1, wherein the beam-column is prestressed.

* * * * *